US007196669B2

(12) United States Patent
Chiou et al.

(10) Patent No.: US 7,196,669 B2
(45) Date of Patent: Mar. 27, 2007

(54) WIRELESS TELECOMMUNICATION DEVICE

(75) Inventors: Tzeng-Chih Chiou, Sindian (TW); I-Yin Li, Banclao (TW)

(73) Assignee: BenQ Corporation, Taoyuan Shien (TW)

( * ) Notice: Subject to any disclaimer, the term of this patent is extended or adjusted under 35 U.S.C. 154(b) by 22 days.

(21) Appl. No.: 11/110,929

(22) Filed: Apr. 21, 2005

(65) Prior Publication Data

US 2005/0237246 A1 Oct. 27, 2005

(30) Foreign Application Priority Data

Apr. 22, 2004 (TW) ..... 93111320 A

(51) Int. Cl.
*H01Q 1/24* (2006.01)
*H01Q 1/52* (2006.01)

(52) U.S. Cl. ..... 343/702; 343/841

(58) Field of Classification Search ..... 343/841, 343/702

See application file for complete search history.

(56) References Cited

U.S. PATENT DOCUMENTS 6,138,050 A * 10/2000 Schneider et al. ..... 700/84
6,867,746 B1 * 3/2005 Mendolia et al. ..... 343/841
2003/0148784 A1 * 8/2003 Sawamura et al. ..... 455/550
2006/0139216 A1 * 6/2006 Glocker et al. ..... 343/702

* cited by examiner

*Primary Examiner*—Trinh Vo Dinh
(74) *Attorney, Agent, or Firm*—Rabin & Berdo, PC

(57) ABSTRACT

A wireless telecommunication device is disclosed. The wireless telecommunication device includes a printed circuit board, an antenna, an insulating layer, and an electrostatic discharge layer. The antenna is electrically coupled with the printed circuit board for transmitting a wireless signal received or sent by the printed circuit board. The insulating layer is disposed between the printed circuit board and the electrostatic discharge layer. At least a clean area exists in the electrostatic discharge layer and the clean area is configured corresponding to the source area of high frequency noises on the printed circuit board. The purpose of the clean area is to create a leaking channel for high frequency noises and decrease the interference toward the antenna from high frequency noises.

15 Claims, 8 Drawing Sheets

WIRELESS TELECOMMUNICATION DEVICE

This application claims the benefit of Taiwan application Serial No. 93111320 filed Apr. 22, 2004, the subject matter of which is incorporated herein by reference.

BACKGROUND OF THE INVENTION

1. Field of the Invention

The invention relates in general to a wireless telecommunication device, and more particularly to a wireless telecommunication device which reduces noise interference towards an antenna.

2. Description of the Related Art

For a wireless telecommunication device such as a hand-held mobile phone, external static electricity is mainly originated from the fingers. It is easy for a person to carry static electricity especially under a cold and dry environment. When a user touches a button with his/her finger which carries static electricity, static electricity will be transmitted to the button from the tip of the finger. Therefore, the interference of electrostatic discharge (ESD) may be happen and harmful to the wireless telecommunication device inside an electronic element.

To prevent the interference of external static electricity, conventional wireless telecommunication device has a grounded conducting layer disposed under the button of a mobile phone. The conducting layer can discharge the instant static electricity originated from external sources to provide sufficient electrostatic discharge (ESD) and maintain electrical characteristics of the mobile phone stable.

However, the conducting layer for preventing external static electricity is like a shield to high frequency noises generated by a printed circuit board inside a wireless telecommunication device. This shielding effect will incapacitate high frequency noises to penetrate the conducting layer and be radiated along a direction perpendicular to the conducting layer, so the high frequency noise will gather around and be radiated from the edge of the conducting layer.

Consequently, the wireless sensitivity of the antenna disposed adjacent to the edge of the conducting layer will be greatly affected. A poor wireless sensibility affects the performance of an electronic telecommunication device greatly and is thus highly undesired by designers.

SUMMARY OF THE INVENTION

It is therefore an object of the invention to provide a wireless telecommunication device, which changes the radiation field of high frequency noises and enhances wireless sensitivity of an antenna by forming a metal layer clean area on an electrostatic discharge layer of a metal dome.

The invention achieves the above-identified object by providing a wireless telecommunication device including a printed circuit board, an antenna, an insulating layer and an electrostatic discharge layer. The printed circuit board has a source area of high frequency noises disposed thereon. The area is normally the position of an element such as a digital signal cable, a pulse signal generator, a digital circuit unit, or a through hole of a multiple layer printed circuit board. The antenna is adjacent to one side of the printed circuit board for receiving or sending a wireless signal. The insulating layer is disposed between the printed circuit board and the electrostatic discharge layer, so that electromagnetic interference (EMI) can be prevented and that electrostatic protection can be achieved.

Due to the shielding effect of the electrostatic discharge layer, high frequency noises radiated via the source area of high frequency noises will be repeatedly reflected between the electrostatic discharge layer and the printed circuit board, interfering with the wireless sensibility of the antenna. So, the electrostatic discharge layer needs to have at least a clean area whose position corresponds to the position of the source area of high frequency noises. The clean area is to create a leaking channel for high frequency noises and to reduce the interference towards the antenna from high frequency noise. Preferably, the distance between the edge on the opening of the clean area and any noise generator inside the source area of high frequency noises has the length of at least 1/100 of the wave-length of the wireless signal transmitted by the antenna.

In the wireless telecommunication device according to the invention; several domes are disposed underneath the insulating layer, and several buttons corresponding to the button caps are disposed above the electrostatic discharge layer.

In the wireless telecommunication device according to the invention, the electrostatic discharge layer is a grounded metal layer. Moreover, the distance between the end of the electrostatic discharge layer adjacent to the antenna and the antenna is a fixed interval, and preferably has the length of at least the length of 1/100 of the wave-length of the wireless signal transmitted by the antenna.

According to another object of the invention, an electronic telecommunication device including a printed circuit board, an antenna, an insulating layer and an electrostatic discharge layer is provided. The printed circuit board has a source area of high frequency noises disposed thereon. The area is normally the position of an element such as a digital signal cable, a pulse signal generator, a digital circuit unit, or a through hole on a multiple layer printed circuit board. The printed circuit board has an antenna feeding point disposed on one side of the printed circuit board for receiving or sending a wireless signal.

An insulating layer is disposed between the printed circuit board and a plurality of domes. A partial area on another surface of the insulating layer is coated with a conducting material to form an electrostatic discharge layer. Several buttons corresponding to the button caps are disposed above the electrostatic discharge layer. The area uncoated with any conducting material will form a clean area. The position of the clean area corresponds to the position on which the source area of high frequency noises is disposed for changing an electromagnetic radiation field of high frequency noises generated by the source area of high frequency noises, so that the high frequency noises can be radiated via the clean area, thereby enhancing the antenna.

Other objects, features, and advantages of the invention will become apparent from the following detailed description of the preferred but non-limiting embodiments. The following description is made with reference to the accompanying drawings.

DETAILED DESCRIPTION OF THE INVENTION

First Embodiment

Figure 1:
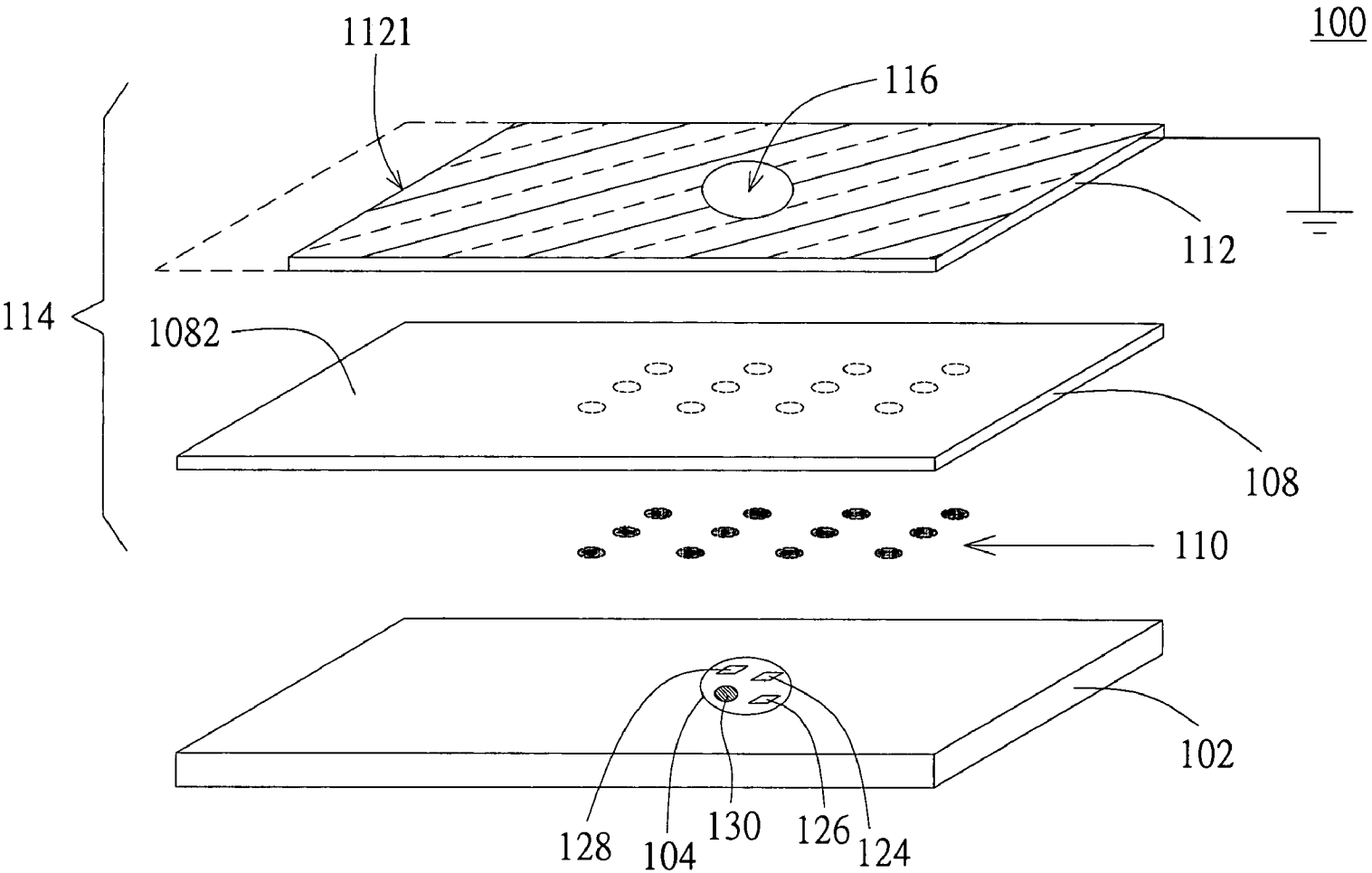
FIG. 1 is an exploded view of a printed circuit board and metal dome of a wireless telecommunication device according to a first embodiment of the invention.
Figure 2A:
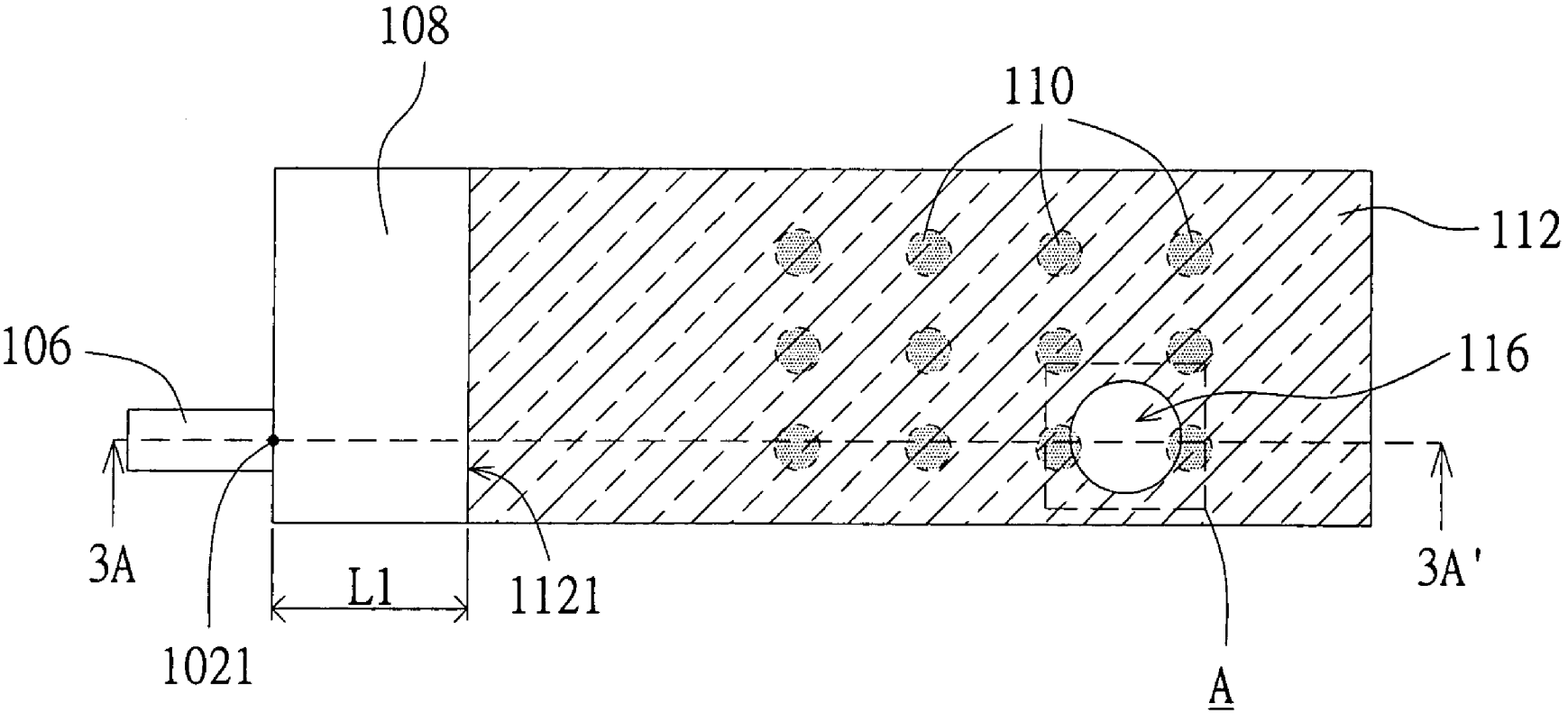
FIG. 2A is a top view of a metal dome of a wireless telecommunication device according to the first embodiment of the invention.
Figure 2B:
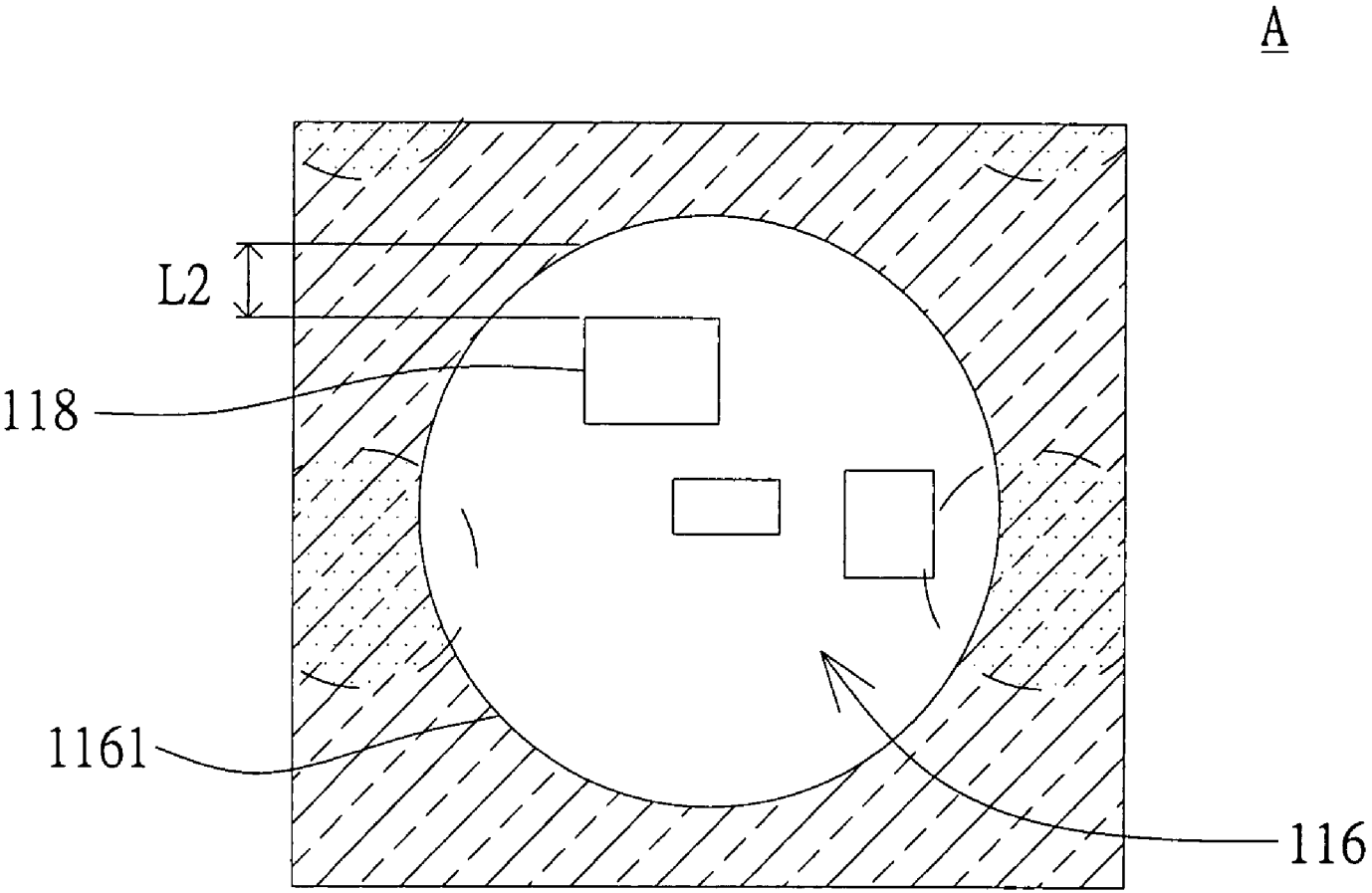
FIG. 2B is an enlarged view of an area A in FIG. 2A.
Figure 3:
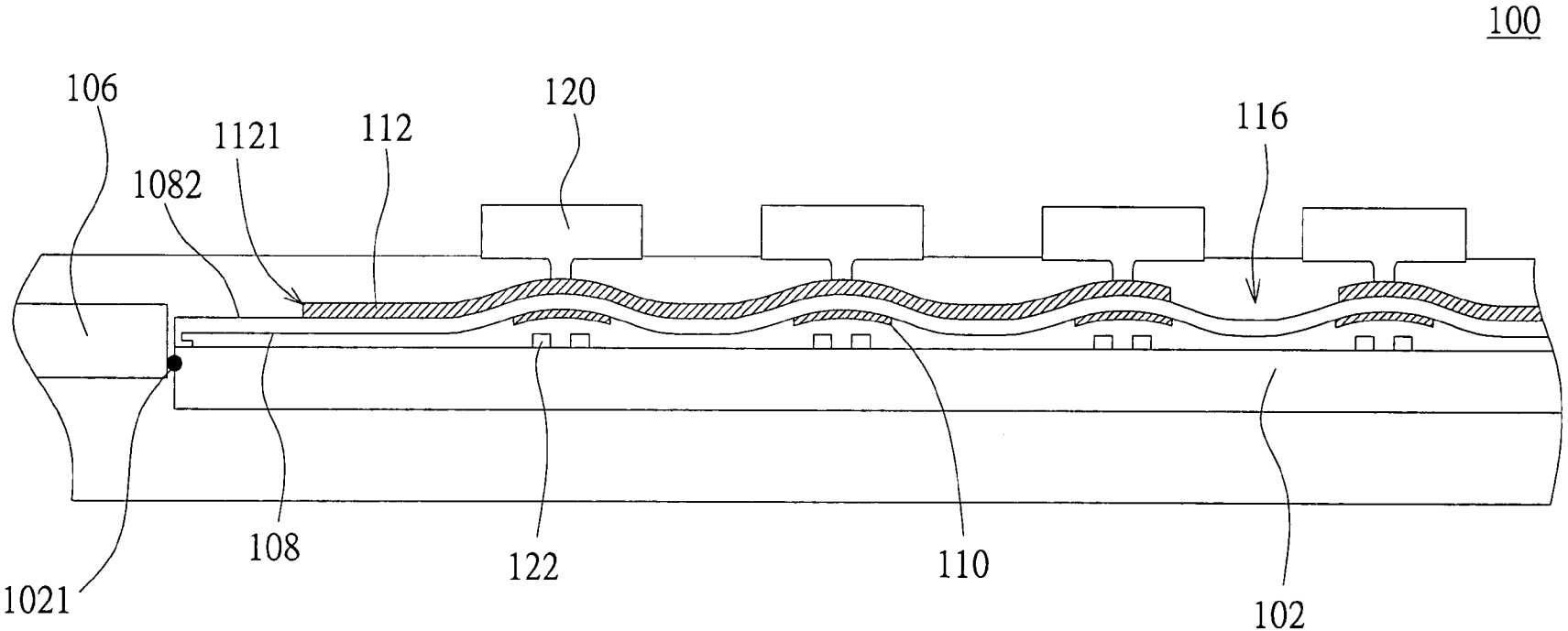
FIG. 3 is a cross-sectional view of a wireless telecommunication device along the cross-sectional line 3A–3A' in FIG. 2.

Refer to FIG. 1, FIG. 2A, and FIG. 3 at the same time. FIG. 1 is an exploded view of a printed circuit board and metal dome of a wireless telecommunication device according to the first embodiment of the invention. FIG. 2A is a top view of a metal dome of a wireless telecommunication device according to the first embodiment of the invention. FIG. 3 is a cross-sectional view of a wireless telecommunication device 100 along the cross-sectional line 3A–3A' in FIG. 2.

Electronic telecommunication device 100 includes a printed circuit board 102, an antenna 106, an insulating layer 108 and an electrostatic discharge layer 112. The electrostatic discharge layer 112 is coated on the surface of the insulating layer 108. The printed circuit board 102 has a source area of high frequency noises 104. The source area of high frequency noises 104 is an area with more high frequency noises obtained when the distribution of the high frequency noise on the printed circuit board 102 is measured using an apparatus. The area is normally the position of elements such as a digital signal cable, a pulse signal generator, a digital circuit unit or a through hole of multiple-layer printed circuit board, and can be pre-measured according to the position of the elements.

The printed circuit board 102 has an antenna feeding point 1021 disposed on one side of the printed circuit board 102 for coupling the antenna 106 and for transmitting a wireless signal received or sent by the printed circuit board 102.

The insulating layer 108 is disposed on the printed circuit board 102 with a plurality of domes 110 disposed underneath. Besides, an electrostatic discharge layer 112 is formed on a first surface 1082 of the insulating layer. The electrostatic discharge layer 112 is grounded and is formed via a metal conducting material coated on a partial area on the first surface 1082. The insulating layer 108, the dome 110 and the electrostatic discharge layer 112 together form a metal dome 114. Besides, a plurality of buttons 120 (as shown in FIG. 3) corresponding to the dome 110 are disposed above the electrostatic discharge layer 112. When the buttons 120 are pressed down, the dome 110 contacts and becomes electrically conducted with an electrode 122.

A clean area 116 on the electrostatic discharge layer 112 is formed on a partial area of the first surface 1082 of the insulating layer 108. The partial area is not coated with any conducting metal material, and the clean area 116 can be a near circular area. The clean area 116 corresponds to the source area of high frequency noises 104 for changing an electromagnetic radiation field of high frequency noises generated by the source area of high frequency noises 104, so that the high frequency noises can be radiated via the clean area 116 to reduce the interference towards the antenna 106 from high frequency noises and that the wireless sensibility of the antenna 106 can be enhanced. The source area of high frequency noises 104 may include at least a noise generator 118 which generates high frequency noises. The noise generator 118 can be a digital circuit unit 124, a pulse signal generator 126, a digital signal cable 128, or a discontinuous surface formed by a through hole 130. Other elements which can generate high frequency noises are an address bus, or a data bus (not shown in the diagram), for example.

Apart from the position of the disposition of the clean area 116, the position of the edge of the electrostatic discharge layer 112 also affects the wireless sensibility of the antenna 106. That is to say, when the edge of the electrostatic discharge layer 112 is too close to the antenna 106, more high frequency noises which interfere with the antenna 106 will be generated, affecting the reception of the antenna 106.

So, the distance between a first edge 1121 of the electrostatic discharge layer 112 and the antenna feeding point 1021 on the printed circuit board 102 has to be larger than a first predetermined distance L1 in order to reduce the interference towards the antenna 106. Since part of the high frequency noises generated by the source area of high frequency noises 104 are radiated via the clean area 116, the remaining high frequency noises can be radiated via the first edge 1121 of the electrostatic discharge layer 112. Due to the distance between the antenna feeding point 1021 and the first edge 1121 being larger than the first predetermined distance L1, the high frequency noises radiated via the first edge 1121 will have lesser impact on the antenna 106. The first predetermined distance L1 at least has the length of 1/100 of the wave-length of the wireless signal transmitted by the antenna 106 to produce a better effect.

As shown in FIG. 2A, a clean area not covered by the electrostatic discharge layer 112 is formed between the insulating layer 108 and the antenna feeding point 1021. That is, part of the high frequency noises will be radiated via the clean area so as to reduce the interference towards the antenna 106.

FIG. 2B is an enlarged view of an area A in FIG. 2A. When the distance between a third edge 1161 of the clean area 116 on the electrostatic discharge layer 112 and any noise generator 118 such as a digital circuit unit 124, a pulse signal generator 126, a digital signal cable 128 or through hole 130 is at least a second predetermined distance L2, the received or transmitted noises will be reduced. In other words, the distance between the third edge 1161 of the clean area 116 and any noise generators 118 must be larger than L2, and a better effect can be achieved if the distance L2 at least has the length of 1/100 of the wave-length of the wireless signal transmitted by the antenna 106.

Figure 4:
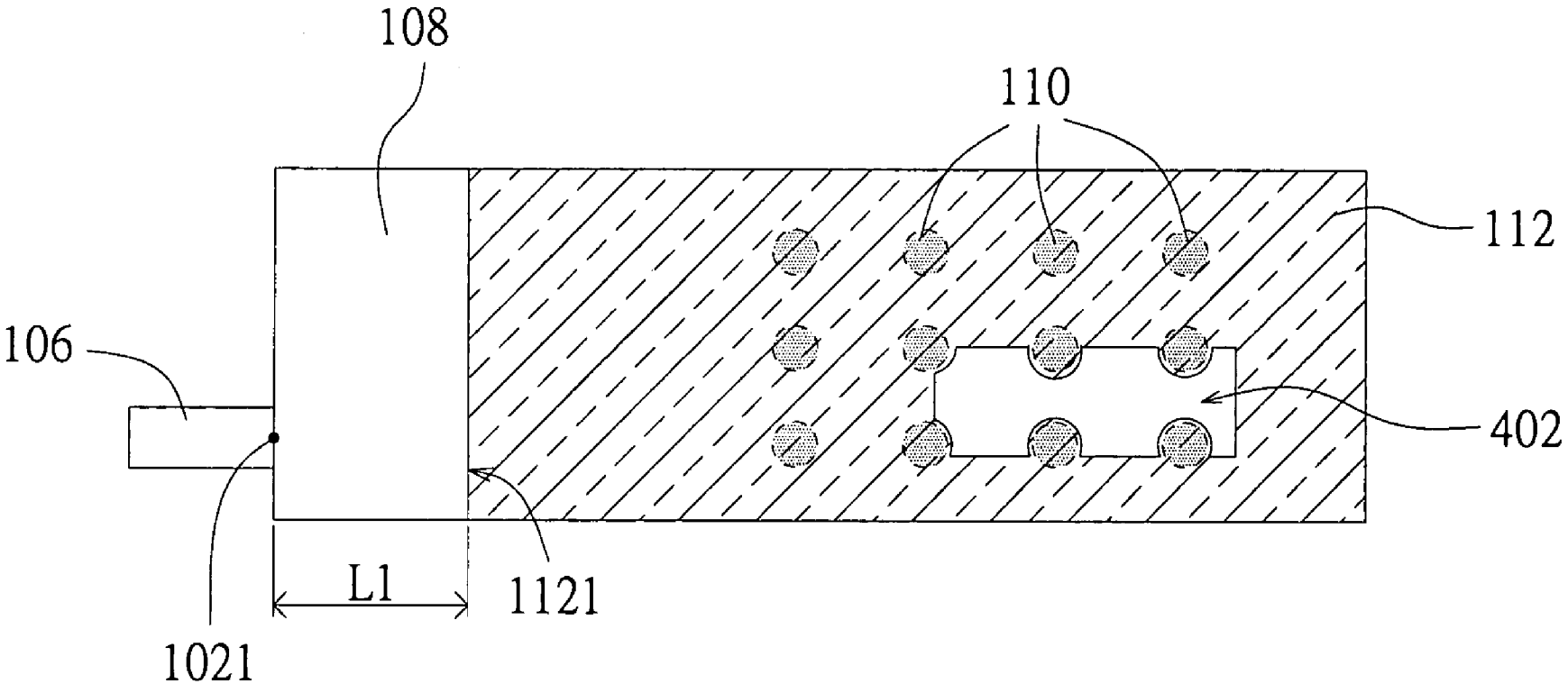
FIG. 4 is a top view of a wireless telecommunication device according to the first embodiment of the invention when clean area 402 is a near rectangular area.

Besides, the shape of the clean area is not limited to that of the clean area 116 which is near circular. Referring to FIG. 4, a top view of a wireless telecommunication device according to the first embodiment of the invention when clean area 402 is a near rectangular area is shown. In FIG. 4, the clean area 402 does not include the area corresponding to the dome 110.

Figure 5A:
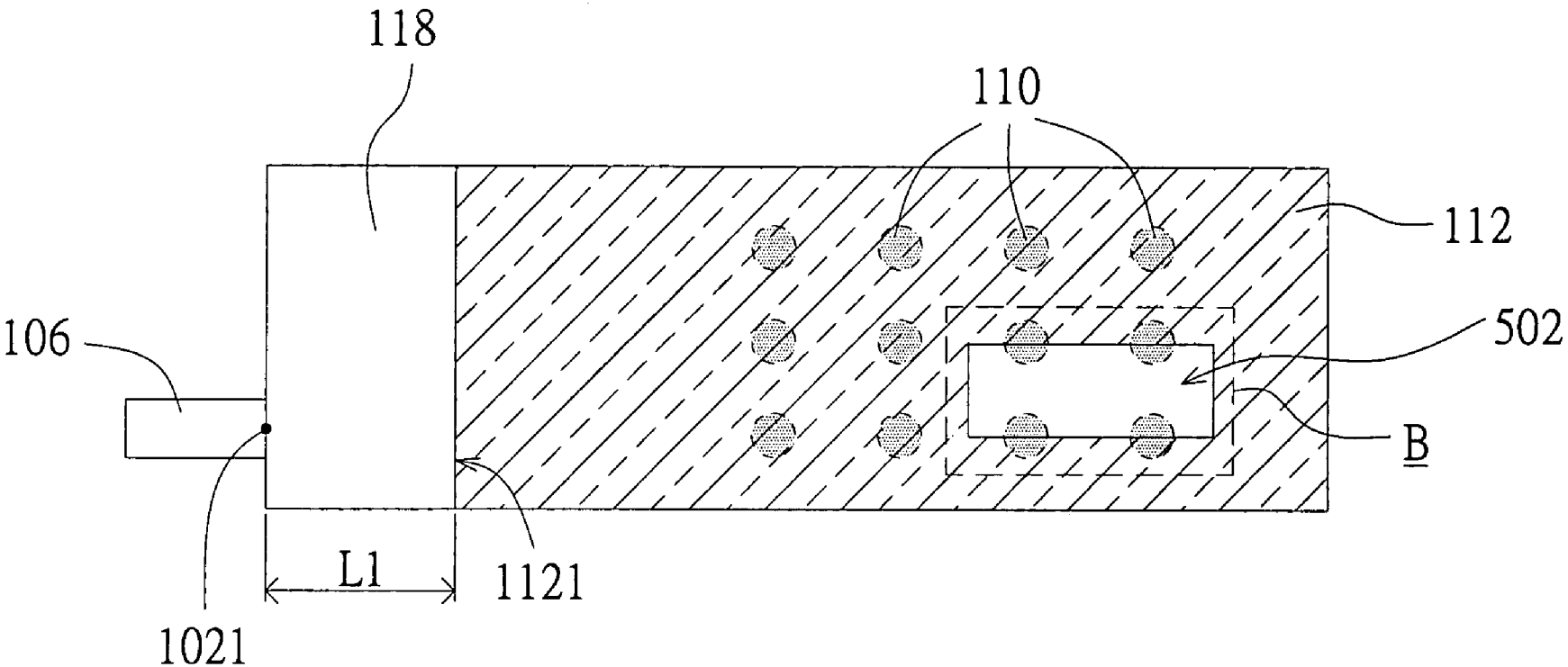
FIG. 5A is a top view of a wireless telecommunication device according to the first embodiment of the invention when clean area 502 is a near rectangular area.
Figure 5B:
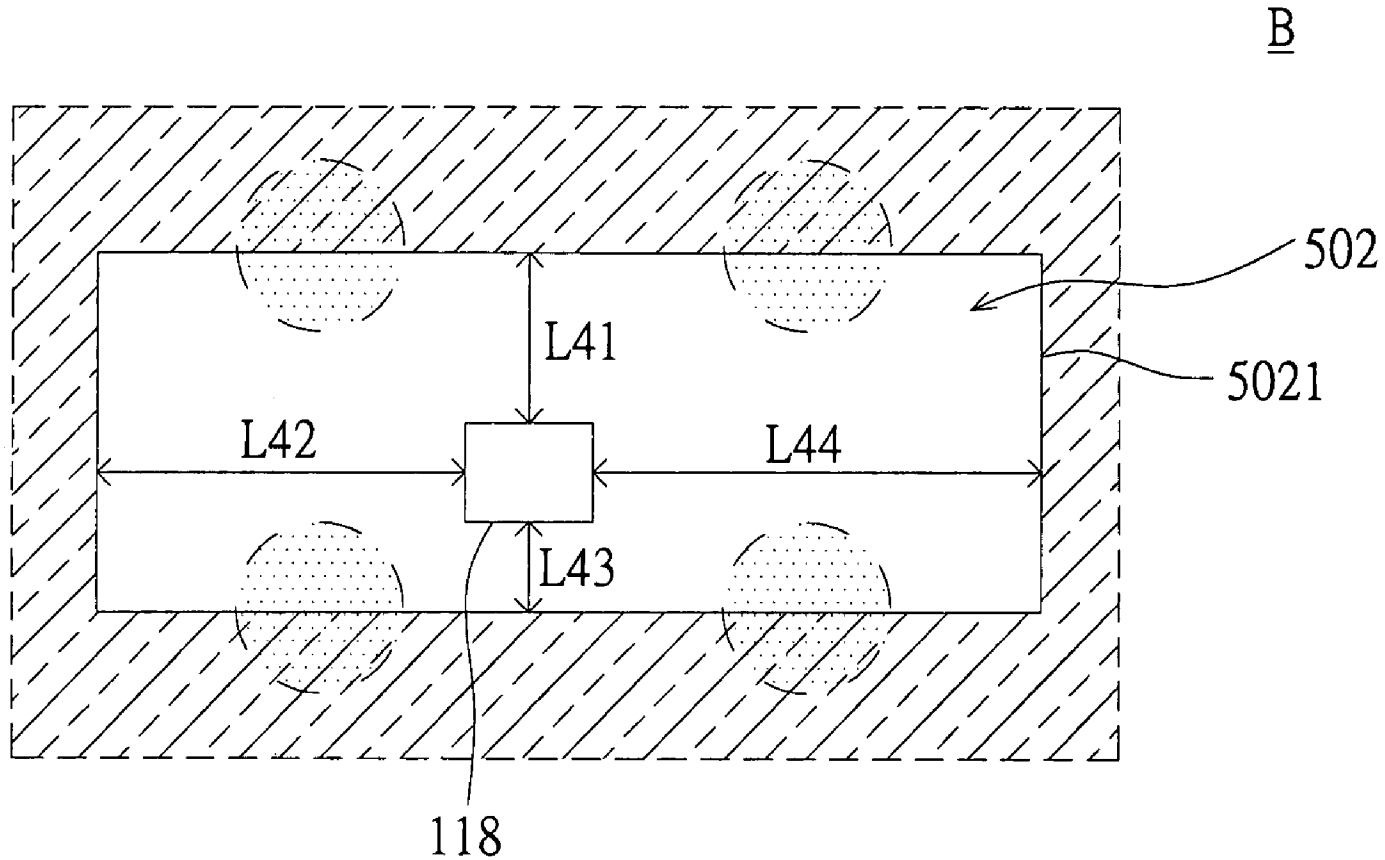
FIG. 5B is an enlarged view of an area B in FIG. 5A.

Refer to both FIG. 5A and FIG. 5B. FIG. 5A is a top view of a wireless telecommunication device according to the first embodiment of the invention when clean area 502 is a near rectangular area. FIG. 5B is an enlarged view of an area B in FIG. 5A. In FIG. 5B, when the length of the distance between the clean area 502 and any noise generator 118 is L41, L42, L43 and L44, the received or transmitted noises will be reduced, wherein a best effect can be achieved if the length of L41, L42, L43 and L44 at least has the length of 1/100 of the wave-length of the wireless signal transmitted by the antenna 106.

It can be understood from above disclosure that when the clean area 116, 402 or 502, which does not have a shielding effect, is correspondingly disposed on the source area of high frequency noises 104, the radiation field of high frequency noises can be changed, so that fewer high frequency noises will gather around and be radiated via the antenna 106. The invention not only prevents static electricity but also enhances the wireless sensibility of the antenna 106.

Second Embodiment

Figure 6:
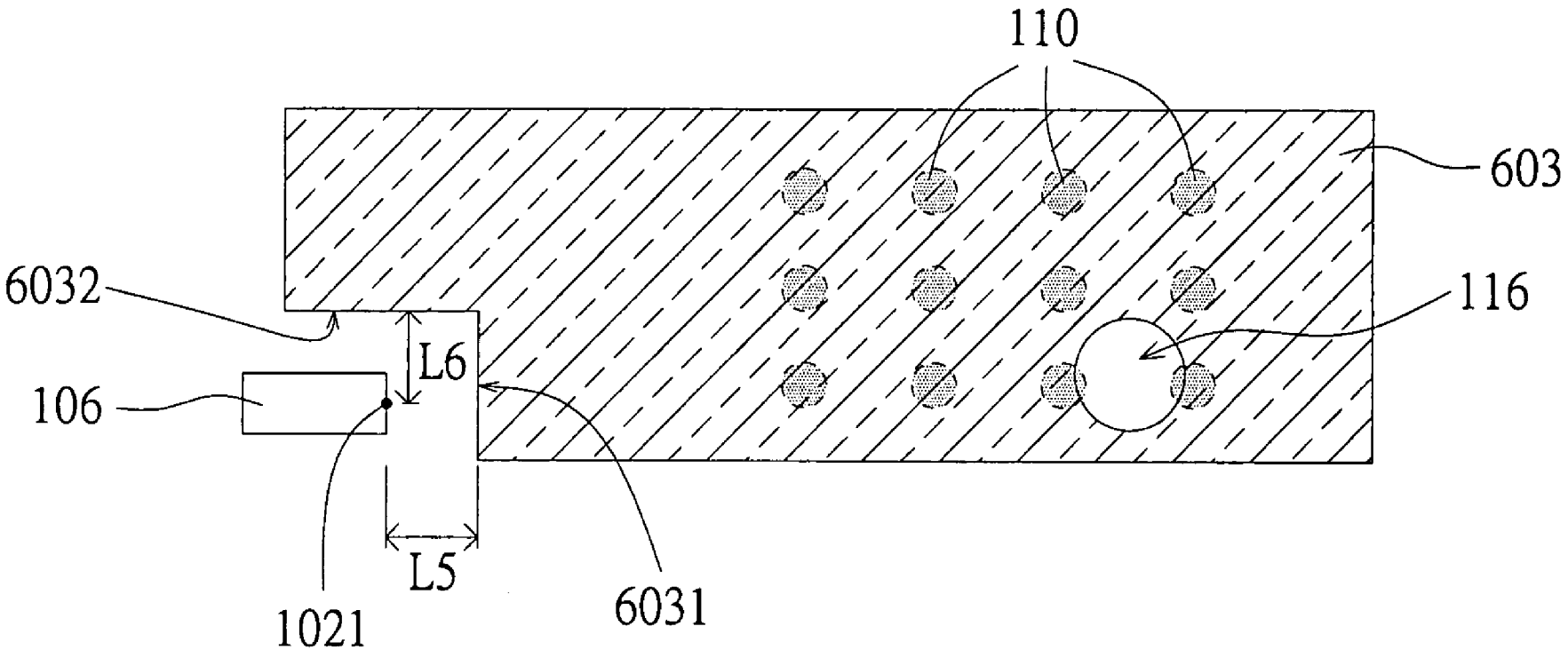
FIG. 6 is a top view of a metal dome of an electronic telecommunication device according to a second embodiment of the invention.

Referring to FIG. 6, a top view of a metal dome of an electronic telecommunication device according to the second embodiment of the invention is shown. The second embodiment differs with the first embodiment in the shape of an electrostatic discharge layer 603 and the corresponding position between an antenna feeding point 1021 and an electrostatic discharge layer 603; other similar elements, have the same labeling and are not repeated here.

The electrostatic discharge layer 603 has a first edge 6031 and a second edge 6032, wherein the first edge 6031 and the second edge 6032 are adjacent to the antenna feeding point 1021 at a distance at least equal to predetermined distance L5 and L6 respectively. That is, the first edge 6031 and the second edge 6032 are respectively at least a predetermined distance L5 and a predetermined distance L6 away from the antenna feeding point 1021. The first edge 6031 and the second edge 6032 are substantially perpendicular to each other, and a better effect can be achieved if L5 and L6 respectively have at least the length of 1/100 of the wave-length of the wireless signal transmitted by the antenna 106.

With the changes made in the design of the electrostatic discharge layer and in the relative position between the electrostatic discharge layer and the antenna, the wireless telecommunication device disclosed in above embodiments of the invention changes the radiation field of high frequency noises and reduces the interference toward the antenna from high frequency noises so as to enhance the wireless sensitivity of the electronic telecommunication device.

While the invention has been described by way of example and in terms of embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A wireless telecommunication device comprising:

a printed circuit board having a source area of high frequency noises;

an antenna adjacent to one side of the printed circuit board for transmitting a wireless signal received to or sent by the printed circuit board;

an insulating layer disposed on the printed circuit board; and an electrostatic discharge layer disposed on the insulating layer, wherein the electrostatic discharge layer has at least a clean area whose position corresponds to the position of the source area of high frequency noises.

2. The wireless telecommunication device according to claim 1, wherein the insulating layer includes a plurality of domes disposed thereunder, while the electrostatic discharge layer includes a plurality of buttons disposed thereabove and corresponding to the domes.

3. The wireless telecommunication device according to claim 1 wherein the electrostatic discharge layer is coated on the insulating layer by using a metal coating, while the electrostatic discharge layer is grounded.

4. The wireless telecommunication device according to claim 1, wherein the electrostatic discharge layer has a first edge adjacent to the antenna, the antenna is coupled with a feeding point of the printed circuit board, and the distance between the feeding point and the electrostatic discharge layer is larger than a predetermined interval.

5. The wireless telecommunication device according to claim 4, wherein the predetermined distance has the length of at least 1/100 of the wave-length of the wireless signal transmitted by the antenna.

6. The wireless telecommunication device according to claim 4, wherein the electrostatic discharge layer has a second edge substantially perpendicular to the second edge, and the distance between the second edge and the feeding point is larger than the predetermined interval.

7. The wireless telecommunication device according to claim 1, wherein the source area of high frequency noises has at least a noise generator.

8. The wireless telecommunication device according to claim 7, wherein the noise generator is a digital circuit unit, a pulse signal generator, a through hole or a digital signal cable.

9. The wireless telecommunication device according to claim 7, wherein the clean area has a third edge, and the distance between the third edge and any noise generator is larger than a predetermined interval.

10. The wireless telecommunication device according to claim 9, wherein, the predetermined distance has the length of at least 1/100 of the wave-length of the wireless signal transmitted by the antenna.

11. A wireless telecommunication device, comprising:

a printed circuit board having an antenna feeding point;

an antenna coupled with the antenna feeding point for receiving or sending a wireless signal;

an insulating layer disposed on the printed circuit board; and an electrostatic discharge layer adjacent to the insulating layer, wherein the electrostatic discharge layer has a first edge adjacent to the antenna feeding point, and the distance between the first edge and the antenna feeding point is larger than a first predetermined interval, wherein the printed circuit board further comprises at least a noise generator, the electrostatic discharge layer has at least a clean area whose position corresponds to the position of the noise generator so that the distance between the edge of the clean area and any noise generator is larger than a second predetermined interval.

12. The wireless telecommunication device according to claim 11, wherein the second predetermined distance has the length of at least 1/100 of the wave-length of the wireless signal transmitted by the antenna.

13. The wireless telecommunication device according to claim 11, wherein the noise generator is a digital circuit unit, a pulse signal generator, a through hole or a digital signal cable.

14. The wireless telecommunication device according to claim 11, wherein the electrostatic discharge layer is coated on the insulating layer by using a metal coating, while the electrostatic discharge layer is grounded.

15. The wireless telecommunication device according to claim 11, wherein the first predetermined distance has the length of at least 1/100 of the wave-length of the wireless signal transmitted by the antenna.

* * * * *